US005173034A

United States Patent [19]

Riffe

[11] Patent Number: 5,173,034

[45] Date of Patent: Dec. 22, 1992

[54] DISCHARGE MUFFLER FOR REFRIGERATION COMPRESSOR

[75] Inventor: Delmer R. Riffe, Cullman, Ala.

[73] Assignee: White Consolidated Industries, Inc., Cleveland, Ohio

[21] Appl. No.: 732,499

[22] Filed: Jul. 18, 1991

[51] Int. Cl.[5] ..... F04B 21/00; F01N 7/04

[52] U.S. Cl. ..... 417/312; 181/403; 181/272

[58] Field of Search ..... 417/312, 313; 181/403, 181/272, 233, 239

[56] References Cited

U.S. PATENT DOCUMENTS

| | | | |
|---|---|---|---|
| 3,044,688 | 7/1962 | Frank | 417/312 |
| 3,480,206 | 11/1969 | Enemark | 417/312 |
| 3,698,840 | 10/1972 | Hover | 181/403 |
| 4,200,426 | 4/1980 | Linnert | 417/312 |
| 4,401,418 | 8/1983 | Fritchman | 417/312 |
| 4,415,060 | 11/1983 | Bar | 417/312 |
| 4,431,383 | 2/1984 | Boehmler et al. | 417/312 |
| 4,449,610 | 5/1984 | Bar | 417/312 |
| 4,486,153 | 12/1984 | Romer et al. | 417/312 |
| 4,534,710 | 8/1985 | Higuchi et al. | 417/312 |
| 4,573,881 | 3/1986 | Romer et al. | 417/312 |

*Primary Examiner*—Richard A. Bertsch
*Assistant Examiner*—Peter Korytnyk
*Attorney, Agent, or Firm*—Pearne, Gordon, McCoy & Granger

[57] ABSTRACT

A fractional horsepower single cylinder refrigeration compressor utilizes a discharge muffler system having a discharge plenum and a pair of muffler chambers. The muffler chambers and interconnected by a transfer tube while separate passages run from the discharge plenum directly to each of the muffler chambers. One of the muffler chambers is then connected to a discharge line to the exterior of the compressor case.

8 Claims, 4 Drawing Sheets

DISCHARGE MUFFLER FOR REFRIGERATION COMPRESSOR

BACKGROUND OF THE INVENTION

This invention relates generally to fractional horsepower, single reciprocating piston hermetic refrigeration compressors of the type used in household appliances and more particularly to a discharge muffler system for such compressors.

Household refrigerators and freezers generally use relatively low horsepower compressors in the range of 1/6 to ⅓ horsepower, and commonly employ a single reciprocating piston which is driven by a two-pole motor which, with a 60 Hz power supply at a nominal speed of 3600 rpm, and therefore tends to produce noise pulses in a range where the ear is very sensitive. While such compressors utilize an electric motor fixed on a cylinder block, which is resiliently mounted within a sealed heavy sheet steel casing, there still can be a substantial amount of noise transmitted to the surrounding area and this tends to be true even though vibration absorbing exterior mounts are used between the compressor shell and the frame of the refrigerator, as well as the fact that the compressor is usually mounted at the bottom rear of the refrigerator cabinet where it is largely shielded by the refrigerator itself in a typical installation.

In compressors of this type, the interior of the hermetically sealed shell is at the relatively low pressure of the return line from the evaporator while the compressor discharge, at a much higher pressure and temperature, is conducted directly through the compressor shell by a tubing arrangement that provides sufficient flexibility to accommodate the movement of the mechanism within the shell or casing. To control the flow of refrigerant gas through the reciprocating piston compressor, the open end of the cylinder is generally covered by a rigid valve plate on which are mounted reed valves for the suction and discharge sides which communicate through ports or passages in the valve plate to suction and discharge plenums located in a cylinder head overlying the valve plate.

In order to reduce the noise inherently produced in the compression process, suitable mufflers are placed at both the suction and discharge sides of the plenums in the cylinder head. While the pressure is relatively low on the suction side, and therefore the sound is more easily muffled, the pressure on the discharge side is far greater than the suction pressure and under normal running conditions may be approximately ten times the suction pressure. Assuming that the cylinder is substantially filled through the suction valve during the suction stroke of the piston, the discharge reed valve will not open until the pressure within the cylinder exceeds that within the discharge plenum, which therefore requires a pressure increase of ten times the suction pressure before the gases can be discharged into the discharge plenum. Because the pressure must build up to the much higher level, the discharge valve does not open until, assuming a 10:1 ratio of pressures, the last ten percent of the piston stroke which may, assuming sinusoidal motion, be as low as 36 degrees of crankshaft rotation. For this reason, the pulsations at the discharge side of the compressor are shorter and sharper than those on the suction side and, this requires relatively large passages and chambers to avoid restrictions in the flow which would tend to decrease the efficiency of the compressor.

It has been recognized that to avoid excessive pressure buildup in the discharge plenum, the discharge plenum should be made as large in volume as possible and passages leading from the discharge plenum to the remainder of the muffler system should allow the gases to flow easily from the discharge plenum. On the other hand, space considerations within the shell provide some limitation on the size of the cylinder head and the discharge plenum chamber within it and the presence of large passages normally tends to decrease the muffling effect. One highly efficient discharge muffler arrangement is shown in the U.S. Pat. No. 4,401,418 of Jack F. Fritchman, granted Aug. 30, 1983, and assigned to the assignee of this application. With this arrangement, the discharge muffler system includes two large and substantially equal size muffler chambers interconnected by a tube of relatively reduced diameter compared to the other tubes handling the discharge gases. A relatively large diameter short passage conducts the gases from the discharge plenum to the first muffler chamber during the short portion of the cycle in which the gases are discharged into the discharge plenum from the pumping cylinder. The gases can then flow through the reduced diameter tube through the second muffler chamber for further expansion before being conducted through the tube to the discharge of the compressor shell. This arrangement uses a connecting tube in cooperation with the two large chambers to provide an acoustic filter which has proven quite effective in reducing noise, while providing a minimum of restriction to gas flow and therefore promoting high efficiency of the compressor.

SUMMARY OF THE INVENTION

The present invention provides a novel and improved construction for the discharge muffler system of a single reciprocating piston fractional horsepower hermetic compressor which increases the overall efficiency of the compressor without any attendant increase in the compressor noise level. The compressor is constructed substantially as shown and described in the aforesaid U.S. Pat. No. 4,401,418 and utilizes in the muffler system, a pair of muffler chambers located one on each side of the center line of the cylinder bore, away from the valve plate and cylinder head and close to the center line of the crankshaft. The muffler chambers are substantially identical in shape and volume and are preferably formed within the cylinder block as recesses covered by bolted-on sheet steel cups, which are convex to maximize the internal volume of each of the chambers. The two chambers are interconnected by a relatively small diameter transfer tube and one of the chambers is connected directly to the discharge plenum and the cylinder head by a relatively large diameter bore extending through the cylinder block, while the other chamber is connected to a discharge tube extending to the exterior of the compressor shell.

According to the present invention, while the aforesaid construction corresponds to that of the U.S. Pat. No. 4,401,418, it is modified by adding a second bore extending through the cylinder block from the discharge plenum to the second chamber. As a result, when the discharge gases are forced past the discharge valve into the discharge plenum at the end of the compression stroke of the piston, these high-pressure, high-temperature gases within the discharge plenum are able to flow through both of the passages directly into both of the muffler chambers with a minimum of restriction. Because the discharge gases are able to exit the discharge plenum more rapidly into both of the muffler chambers, the peak pressures within the discharge plenum are somewhat reduced by the addition of the second passage leading to the second discharge chamber. However, the relatively small diameter transfer tube between the two chambers still functions as it does in the aforesaid patent and during the major portion of the cycle when the discharge valve is closed, there is a reversal of flow from the first chamber back through its passage into the discharge plenum and from there through second passage to the second chamber in parallel with the transfer tube. However, while this would appear to be contrary to the operation of the muffler as described in the aforesaid U.S. Pat. No. 4,401,418, it has been found by noise measurements that there has been no measurable increase in compressor noise while there has been a noticeable and substantial increase in overall compressor efficiency.

DESCRIPTION OF THE PREFERRED EMBODIMENT

Figure 1:
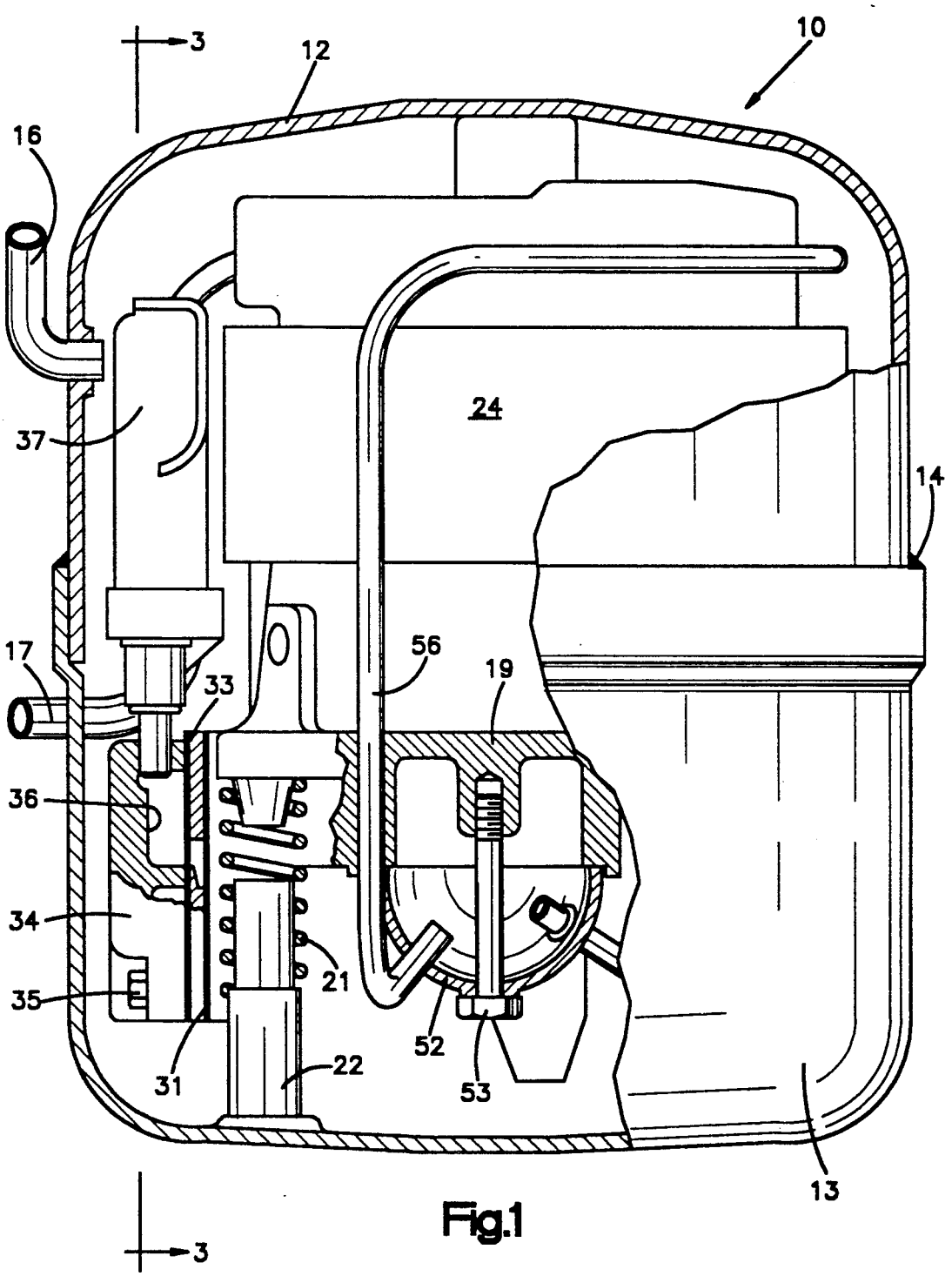
FIG. 1 is a side elevational view, partially in section, of a hermetic refrigeration compressor incorporating the present invention.
Figure 3:
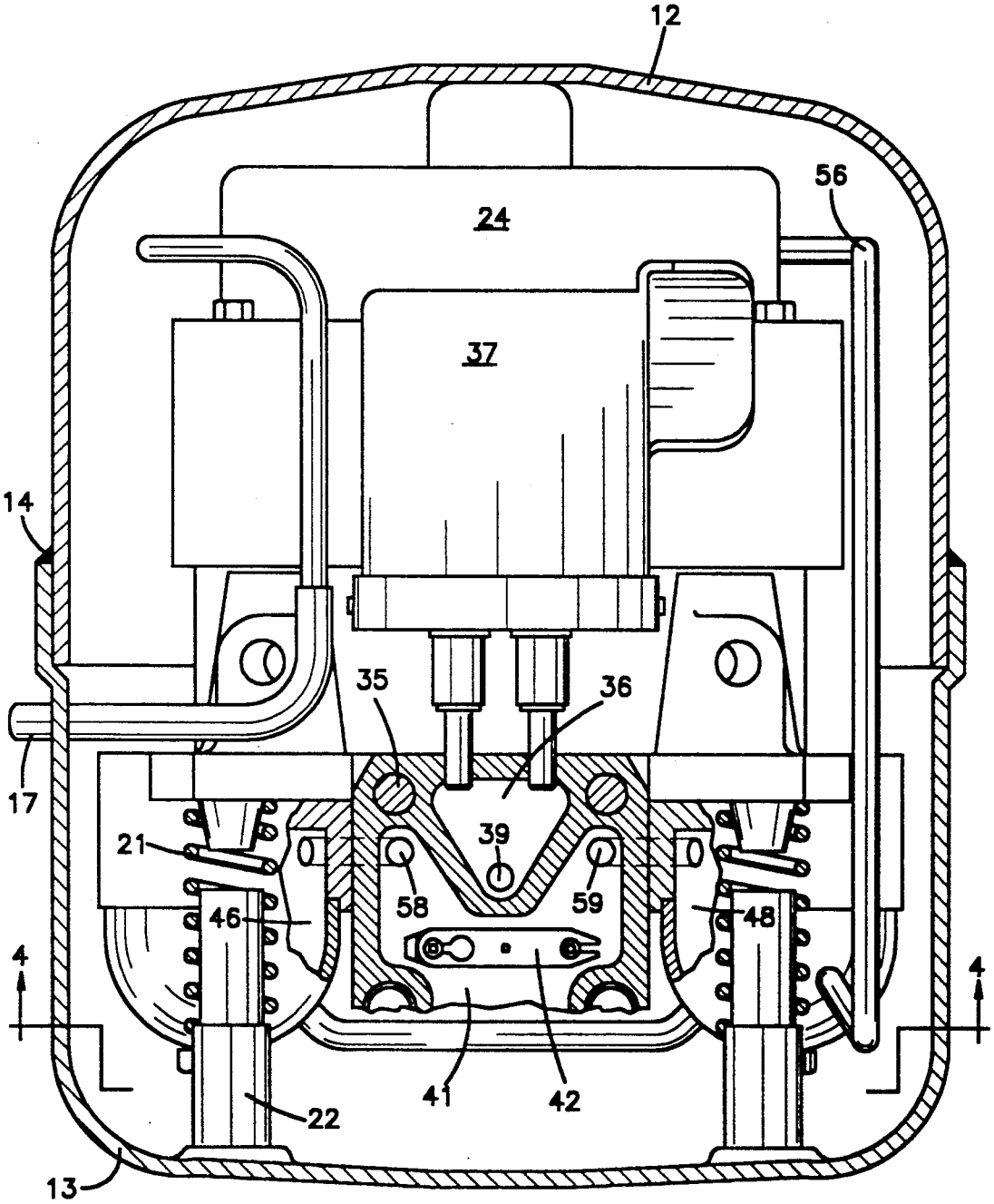
FIG. 3 is a front elevational view partly in section of the compressor shown in FIG. 1.
Figure 4:
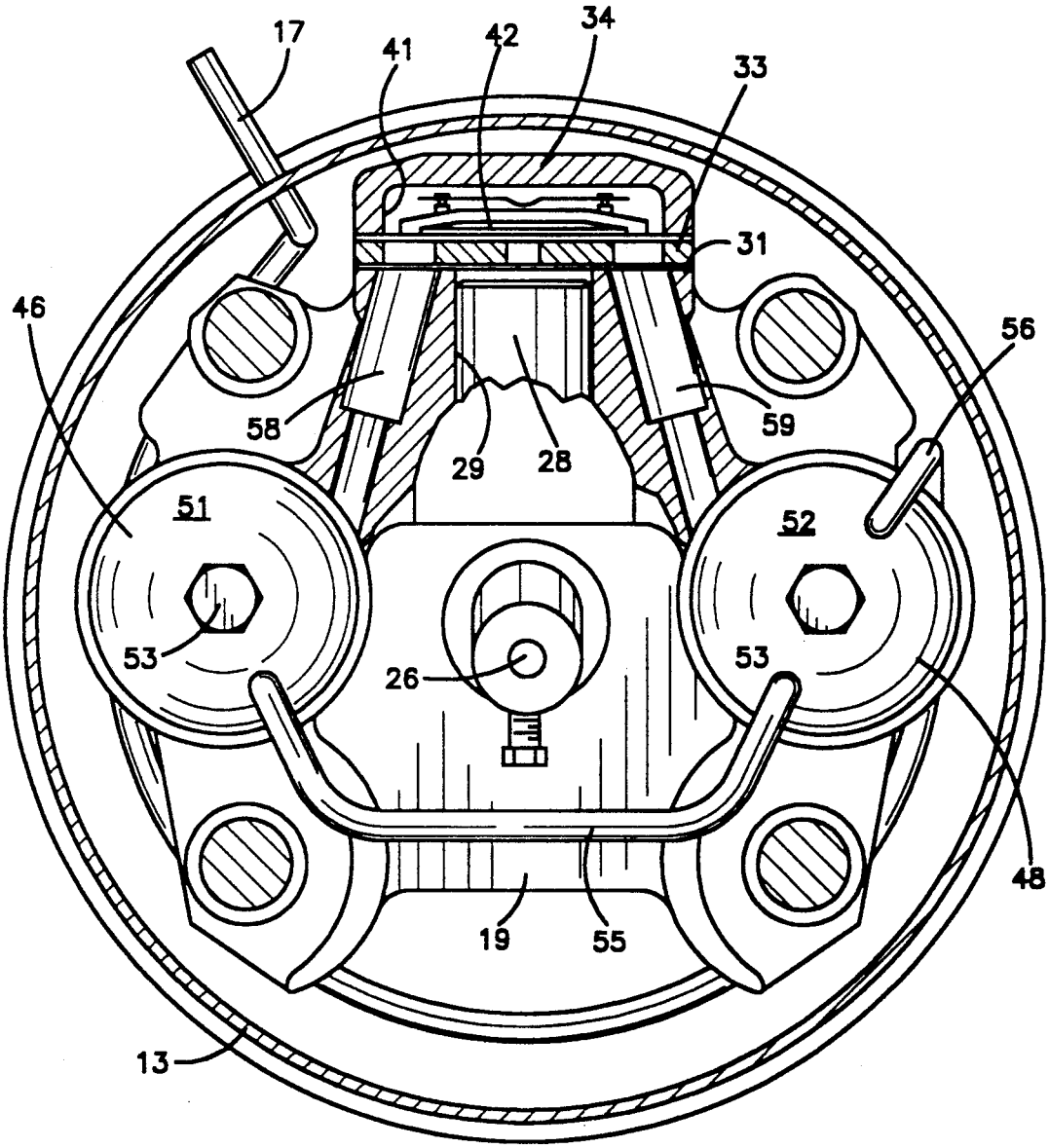
FIG. 4 is a horizontal view partially in section taken on line 4—4 of FIG. 3.

Referring to the drawings in greater detail, and particularly FIGS. 1, 3, and 4, there is shown a typical fractional horsepower single reciprocating piston hermetic compressor of the type commonly used in household refrigerators and freezers. The hermetic sealing of the compressor is provided by a shell 10 comprising an upper half 12 and lower half 13, which are welded together along the peripheral seam 14. The shell is generally formed of heavy-gauge sheet steel to provide sufficient rigidity and reduced noise transmission. The shell 10 is thus completely sealed, except for an inlet line 16, supplying returning refrigerant gas from the evaporator to the interior of the shell as well as a discharge line outlet 17 through which the compressor is connected to the condenser and the remaining portions of the system.

The compressor mechanism within the shell 10 includes a cylinder block 19 which is resiliently mounted within the shell on a plurality of helical compression springs 21 which, at their lower ends, fit over projecting posts 22 secured to the inside wall of the lower shell half 13. The springs 21 provide both vertical and lateral compliance to allow limited movement of the cylinder block 19 and associated structure, particularly during the starting and stopping of the compressor. An electric motor 24 is mounted rigidly on the upper side of the cylinder block 19 and drives a vertically extending rotary crank shaft 26, mounted on suitable bearings on the cylinder block 19. Crank shaft 26 in turn provides reciprocating motion to a piston 28 mounted in cylinder bore 29 and driven through a suitable connecting rod mechanism (not shown) so that the piston 28 is reciprocated in the cylinder bore 29 to and from a vertically extending cylinder block end face 31.

A valve plate 33 is mounted on the end face 31 and on top of the valve plate is also mounted a cylinder head 34. Both the valve plate and cylinder head are held in place by a plurality of bolts 35 extending into the cylinder block. The cylinder head 34 is divided into a suction plenum 36 and discharge plenum 41 and may also serve to mount a suction muffler 37, which receives the returning refrigerant gas from the inlet line 16, and directs it into the suction plenum 36, from which it passes through a suction port 39 into the interior of the cylinder bore 29. It should be understood that the suction port 39 is covered by an inlet valve reed (not shown) which may be mounted between the valve plate 33 and the end face 31. The major portion of the cylinder head 34 is taken up by the discharge plenum 41, which receives the high-temperature, high-pressure, compressed gases from the cylinder 29 through the discharge valve assembly 42 (see FIG. 3).

The discharge muffler arrangement includes first and second muffler chambers 46 and 48, which are preferably formed as recesses in the underside of cylinder block 19, one on either side of the cylinder bore 29 in a symmetrical arrangement. The muffler chambers 46 and 48 are enclosed by hemispherical covers 51 and 52 which are held in place by bolts 53 and the covers 51 and 52 are preferably formed from relatively thick sheet metal to provide rigidity and minimize sound transfer from the muffler chambers 46 and 48. The two chambers are substantially equal in volume and are connected by means of a passage in the form of transfer tube 55 which may be brazed or welded to the covers 51 and 52 while a discharge tube 56 is connected to the second chamber cover 52 and extends around the interior of the compressor shell to make a fluid-type connection to the discharge line outlet 17 after travelling a sufficient distance for flexing purposes to allow resilient movement of the cylinder block 19 on the springs 21. The muffler construction is completed by a pair of generally symmetrical passages 58 and 59 of equal length, each extending from the adjacent side of the discharge plenum 41 directly into the muffler chambers 46 and 48, respectively.

Although refrigerant gas is discharged into the discharge plenum, once for every revolution of the crank shaft 26, the actual duration during which the discharge valve 42 is open is only a small portion of the cycle. This is due to the fact of the differential pressures between the inlet and discharge as well as the fact that the valves used are reed valves that are pressure operated. Thus, under steady state running conditions, the pressure on the discharge side may be ten times the suction pressure or, by way of example, about 250 psi in the discharge line as compare to 25 psi in the suction line. Assuming that the suction valve does allow a complete filling of the cylinder, this requires that the piston move through 9/10 of the distance of its stroke before the pressure with the head of the piston is raised to the pressure on the other side of the discharge valve within the discharge plenum. Assuming that the motion of the piston is a sinusoidal movement, this means that the last 1/10 of the piston stroke during which the discharge valve is open to allow flow from the cylinder into the discharge plenum, represents about 36 degrees of rotation of the crank shaft, or in effect, 1/10 of the complete cycle of one rotation of the crank shaft. This means that the gas enters the discharge plenum in a sharp pulse, resulting in a sharp pressure rise within the discharge plenum which therefore tends to produce relatively large noise spikes. On the other hand, the sharpness of the discharge pulse also means that there is a relatively long period of time over 9/10 of a revolution during which the gases are able to flow through the muffler system and tend to reduce pressures without any additional inflow through the discharge valve. While the peak discharge pressures can be minimized to some extent by increasing the volume of the discharge plenum, there is only a relatively limited amount of volume available because of space and cylinder head strength considerations.

Figure 2A:
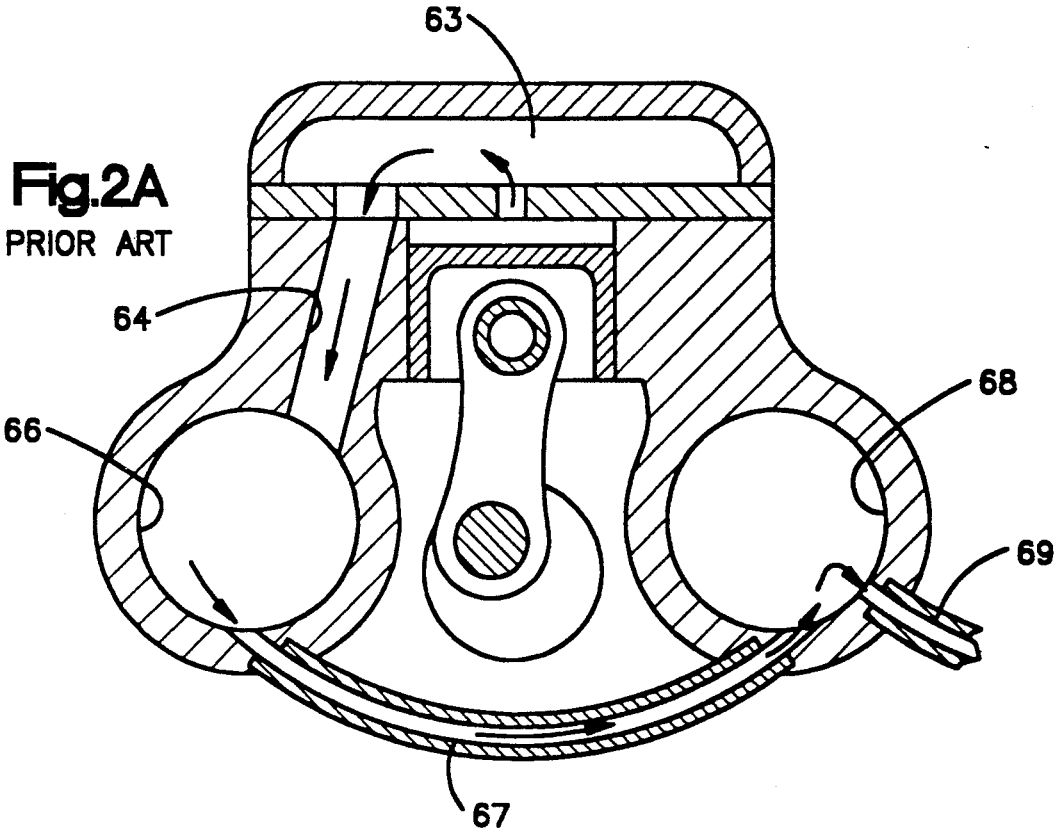
Fig.2A PRIOR ART
FIG. 2A is a schematic horizontal cross sectional view of the prior art arrangement shown in U.S. Pat. No. 4,401,418.
Figure 2B:
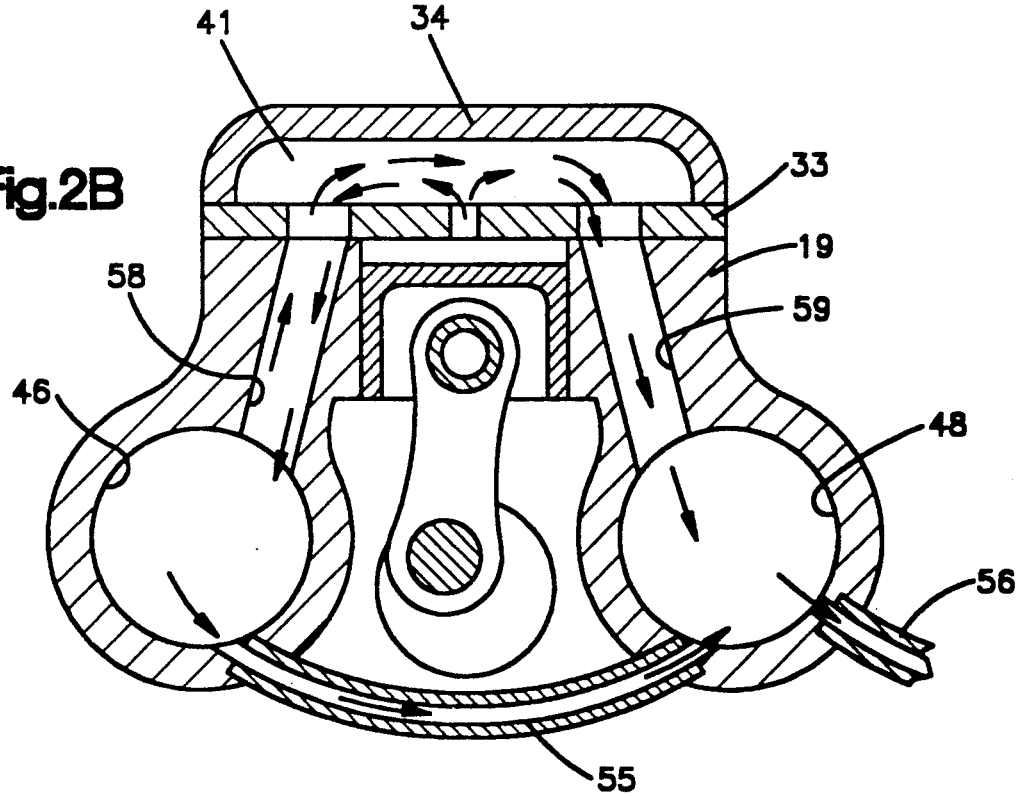
FIG. 2B is a view similar to FIG. 2A, but incorporating the present invention.

In view of this situation, the prior art arrangement as disclosed in the aforesaid U.S. Pat. No. 4,401,418 is shown in FIG. 2A. With this arrangement, the single discharge passage 64 extending between the discharge plenum 63 and the first muffler chamber was made as large in diameter as possible to facilitate the flow from the discharge plenum to the first muffler chamber 66 during the time when the discharge valve is open to minimize the peak pressure in the discharge plenum 63. This ensured that the first muffler chamber 66 was filled rather rapidly so that the gases could take a longer period of time to pass through the restricted transfer tube 67 to the second muffler chamber 68 and hence to the discharge tube 69. It should be noted in this arrangement that the cross sectional area of the passage 64 was made about four times that of both the transfer tube 67 and the discharge tube 69. However, the gases still had to pass in serial sequence through the muffler system.

The present invention adds a second passage 59 to the first passage 58 so that the gases can pass simultaneously from the discharge plenum 41 into both of the muffler chambers 46 and 48. However, at the time when the discharge valve is closed, the outflow from the first muffler chamber 46 is restricted by the transfer tube 55 which also has about ¼ the cross sectional area of the passages 58 and 59. Thus, it is believed that after the discharge valve closes, there is a reversal of flow from the chamber 46 back through the passage 58 into the discharge plenum 41 and from there to the second muffler chamber 48 through passage 59. Because the discharge gases can exit from the discharge plenum 41 through both of the passages 58 and 59 and into both of the muffler chambers 46 and 48, the peak pressures within the discharge plenum are reduced thereby tending to reduce the magnitude of the noise pulses in the system. The presence of the transfer tube 55 ensures the effectiveness of the filter arrangement because of its restrictive flow characteristics between the two muffler chambers 46 and 48, while the reversal of flow through the passage 58 ensures against excessive pressure peaks within the first muffler chamber 46 as well as the discharge plenum 41.

It has been found that modifying an existing compressor by the addition of the second passage 59 can produce an increased efficiency in the range of 1 to 1.5% with all other factors and dimensions remaining the same. It is believed that this increased efficiency results from the fact that the peak pressure within the discharge plenum 41 is somewhat reduced because of the outflow through both of the passages 58 and 59 and this reduction of the peak pressure in the discharge plenum allows slightly increased flow through the discharge valve and therefore reduced mass for the re-expansion gases remaining within the cylinder after the discharge valve closes. On the other hand, noise tests indicate that there is no measurable increase in noise by adding the second passage 59 even though this would appear to bypass and reduce the effectiveness of the filter arrangement defined by the two muffler chambers and the transfer tube between them. Again, this is believed due to the fact that the peak pressures within the discharge plenum are reduced and the reversal of flow through the passage 58 tends to break up any standing waves because of the parallel passages provided by the discharge plenum 41 and the transfer tube 55 during the major portion of the cycle when the discharge valve is closed.

Although the preferred embodiment of this invention has been shown and described, it should be understood that various modifications and rearrangements may be resorted to without departing from the scope of the invention as defined in the claims.

What is claimed is:

1. A hermetic refrigeration compressor comprising a case, a motor compressor mounted inside said case, a discharge line for discharging the output of said compressor from said case, said motor compressor including a cylinder block having a single cylinder and a piston reciprocably mounted therein, a cylinder head secured to said cylinder block and having a discharge plenum for receiving gas compressed by said piston, first and second muffler chambers on said cylinder block, a first passage connecting said discharge plenum to said first muffler chamber, a second passage connecting said discharge plenum to said second muffler chamber, a third passage connecting said first muffler chamber to said second muffler chamber, and a fourth passage connecting one of said muffler chambers to said discharge line.

2. A hermetic refrigeration compressor as set forth in claim 1, wherein said first and second passages are of equal length.

3. A hermetic refrigeration compressor as set forth in claim 2, wherein said first and second passages have a cross sectional area of substantially four times the cross sectional area of said third passage.

4. A hermetic refrigeration compressor comprising a case, a motor compressor mounted inside said case, a discharge line for discharging the output of said compressor from said case, said motor compressor including a cylinder block having a single cylinder defining an axis and a piston reciprocably mounted in said cylinder, a cylinder head secured to said cylinder block and having a discharge plenum for receiving gas compressed by said piston, a discharge valve selectively operable to allow flow of compressed gas from said cylinder into said discharge plenum, first and second muffler chambers on said cylinder block arranged symmetrically on each side of said axis, a first passage in said cylinder block connecting said discharge plenum to said first muffler chamber, a second passage in said cylinder block connecting said discharge plenum to said second muffler chamber, a transfer tube connecting said first muffler chamber to said second muffler chamber, and a discharge tube connecting one of said muffler chambers to said discharge line.

5. A hermetic refrigeration compressor as set forth in claim 4 wherein said first and second passages are sized with respect to said transfer tube to allow a reversal of flow from said first muffler chamber through said first passage to said discharge plenum and from said discharge plenum through said second passage to said second muffler chamber when said discharge valve is closed.

6. A hermetic refrigeration compressor as set forth in claim 5 wherein said first and second passages are of equal length.

7. A hermetic refrigeration compressor as set forth in claim 6 wherein said first and second passages have a cross sectional area of substantially four times the cross sectional area of said transfer tube.

8. A hermetic refrigeration compressor as set forth in claim 4 wherein said first and second muffler chambers are substantially equal in volume.

* * * * *